US006857906B2

(12) United States Patent
Bricaud et al.

(10) Patent No.: US 6,857,906 B2
(45) Date of Patent: Feb. 22, 2005

(54) CONNECTOR THAT OCCUPIES MINIMAL CB SURFACE

(75) Inventors: Hervé Guy Bricaud, Dole (FR); Yves Pizard, Dole (FR)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 10/635,709

(22) Filed: Aug. 5, 2003

(65) Prior Publication Data

US 2004/0033723 A1 Feb. 19, 2004

(30) Foreign Application Priority Data

Aug. 13, 2002 (FR) ..... 02/10279

(51) Int. Cl.[7] ..... H01R 23/70
(52) U.S. Cl. ..... 439/630
(58) Field of Search ..... 439/66, 74, 630, 439/862

(56) References Cited

U.S. PATENT DOCUMENTS 5,746,607 A 5/1998 Bricaud et al.
5,980,323 A * 11/1999 Bricaud et al. ..... 439/630
6,086,424 A * 7/2000 Chang ..... 439/630
6,113,440 A * 9/2000 Fijten et al. ..... 439/862
6,168,082 B1 1/2001 Benjamin et al.
6,315,621 B1 * 11/2001 Natori et al. ..... 439/862
6,409,529 B1 * 6/2002 Liu et al. ..... 439/188

FOREIGN PATENT DOCUMENTS

EP 1227428 A1 7/2002

* cited by examiner

*Primary Examiner*—Thanh-Tam Le
(74) *Attorney, Agent, or Firm*—Roger C. Turner

(57) ABSTRACT

A connector (10) mounted on a circuit board (40), has an insulative frame (12) and two laterally-spaced columns (66, 68) of contacts (14), each contact formed of a bent metal strip and having an upper portion (36) for engaging a contact of a mating device and having a lower portion (38) with a termination end (48) that presses against a trace on the circuit board. Each contact lower portion includes a deflectable section (42) that extends at an acute angle (a) such as 12° from the lateral direction (L). This results in the termination ends of the lower strips, which press against circuit board traces, extending along a single longitudinally-extending line (A), so the traces on the circuit board that engage the contacts, also lie along the single line. The result is that areas on opposite sides of the line of traces, can be used to hold other traces or even circuit components.

9 Claims, 5 Drawing Sheets

CONNECTOR THAT OCCUPIES MINIMAL CB SURFACE

CROSS-REFERENCE

Applicant claims priority from French patent application S.N. FR02/10279 filed Aug. 13, 2002.

BACKGROUND OF THE INVENTION

One type of connector that mounts on a circuit board, includes two longitudinally-extending columns of contacts with the columns being laterally spaced apart, each contact having an upper portion that engages contacts of a mating device, and each contact having a lower portion with a termination end that presses against a circuit board trace. One example of such a connector is a connector that is used with smart cards that have two columns of contact pads on their lower surface. Another type of connector that has two columns of contacts and is mounted on a circuit board, is a track ball device of the type described in PCT/EP 02/02778. Many of these connectors are mounted on circuit boards of limited area such as a circuit board of a portable telephone. Previously, a connector of predetermined length and width occupied an area on the circuit board that was a large portion of such length and width. This left a smaller area on the circuit board for holding multiple traces and components. A connector with at least two longitudinally-extending and laterally-spaced columns of contacts having termination ends that engage circuit board traces, that occupied a minimum space on the circuit board so more circuit board space was available for other traces to route signals or for components, would be of value.

SUMMARY OF THE INVENTION

In accordance with one embodiment of the present invention, a connector is provided for mounting on a circuit board, wherein the connector has two longitudinally-extending and laterally spaced columns of contacts, but the termination ends of the contacts engage circuit board traces that occupy only a narrow strip-like area on the circuit board, thereby leaving more of the circuit board for other traces and/or components. Each contact is formed of a metal strip having opposite edges and a strip centerline. Each contact has an upper portion for engaging a contact of another device such as a smart card, and has a lower portion with an elongated deflectable strip section. Each elongated deflectable strip section extends at an angle of a plurality of degrees from the lateral direction, and has an end that merges with a termination end that engages a trace on the circuit board. The deflectable strip sections of contacts in first and second columns extend in parallel inclines. This results in the termination ends of the contacts being spaced apart along a single longitudinal line on the circuit board, so the circuit board traces occupy only a small strip-like area.

The novel features of the invention are set forth with particularity in the appended claims. The invention will be best understood from the following description when read in conjunction with the accompanying drawings.

DESCRIPTION OF THE PREFERRED EMBODIMENTS

Figures 1, 2, 3, 4, 6:
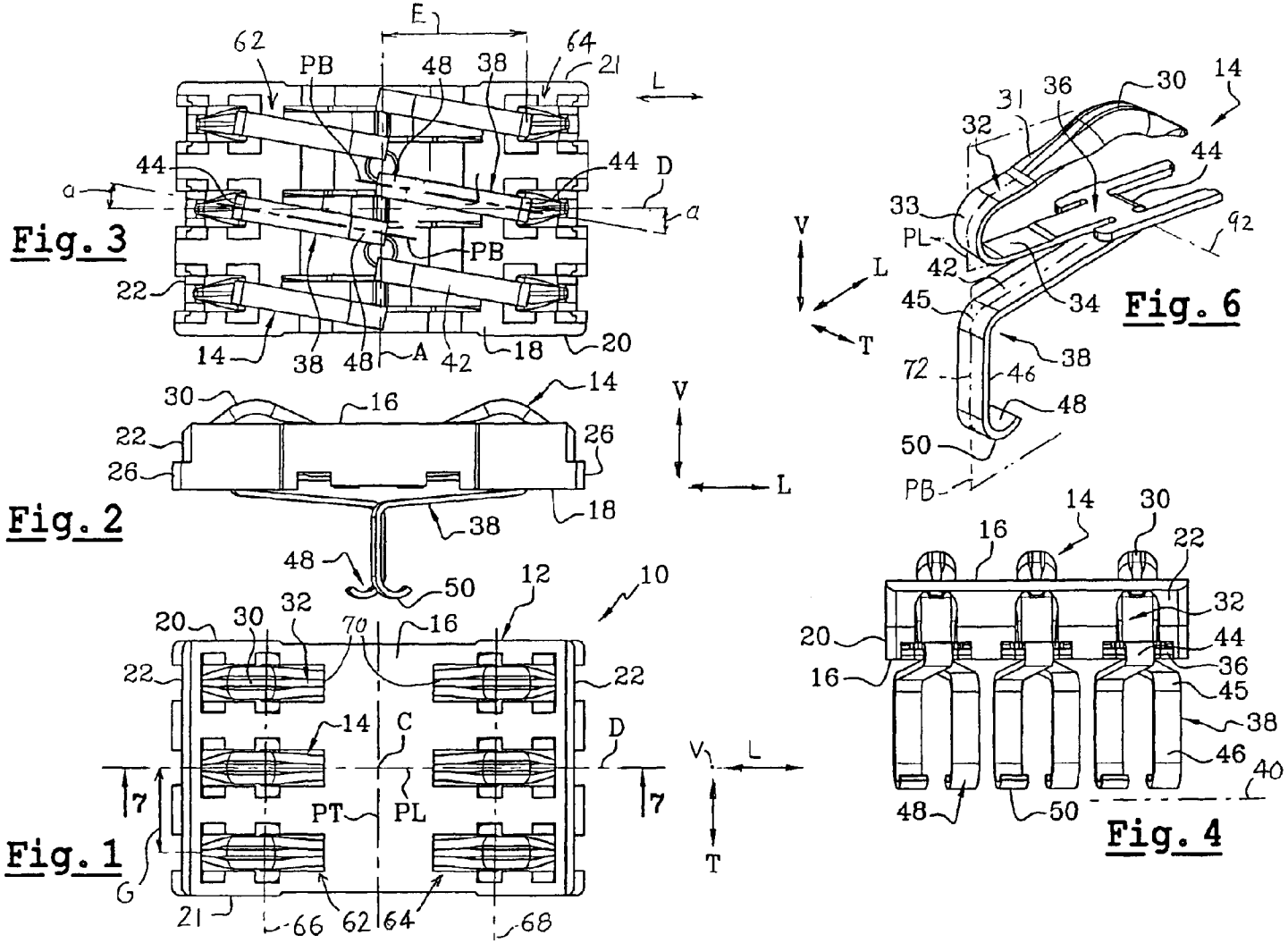
FIG. 1 is a top view of an electrical connector for connecting to a smart card, of the present invention.
FIG. 2 is a side elevation view of the connector of FIG. 1.
FIG. 3 is a bottom view of the connector of FIG. 1.
FIG. 4 is an end view of the connector of FIG. 1, taken from the left side of FIG. 2.
FIG. 6 is an isometric view of one of the contacts of the connector of FIG. 1.

FIGS. 1–4 illustrate a miniature connector 10 that is designed to be mounted on a circuit board 40, in a situation where there is limited space on the circuit board for holding other components and/or for holding conductor traces to route signals or power. As shown in FIG. 1, the connector includes an insulative frame 12 with a top surface 16, longitudinally T spaced sides 20, 21 and laterally L spaced ends 22. The connector carries two columns of contacts 14, including first and second columns of contacts 62, 64. The contacts in each column are spaced apart along corresponding column lines 66, 68. The contacts of the two columns are arranged in pairs such as 70, with the two contacts of each pair being spaced apart in a lateral L direction. All contacts 14 are substantially identical, with the contacts in one column 64 being turned 180° about vertical V axes with respect to the orientations of contacts of the first column 62. The connector is symmetric about two planes PL and PT that intersect at a center C.

Figure 5:
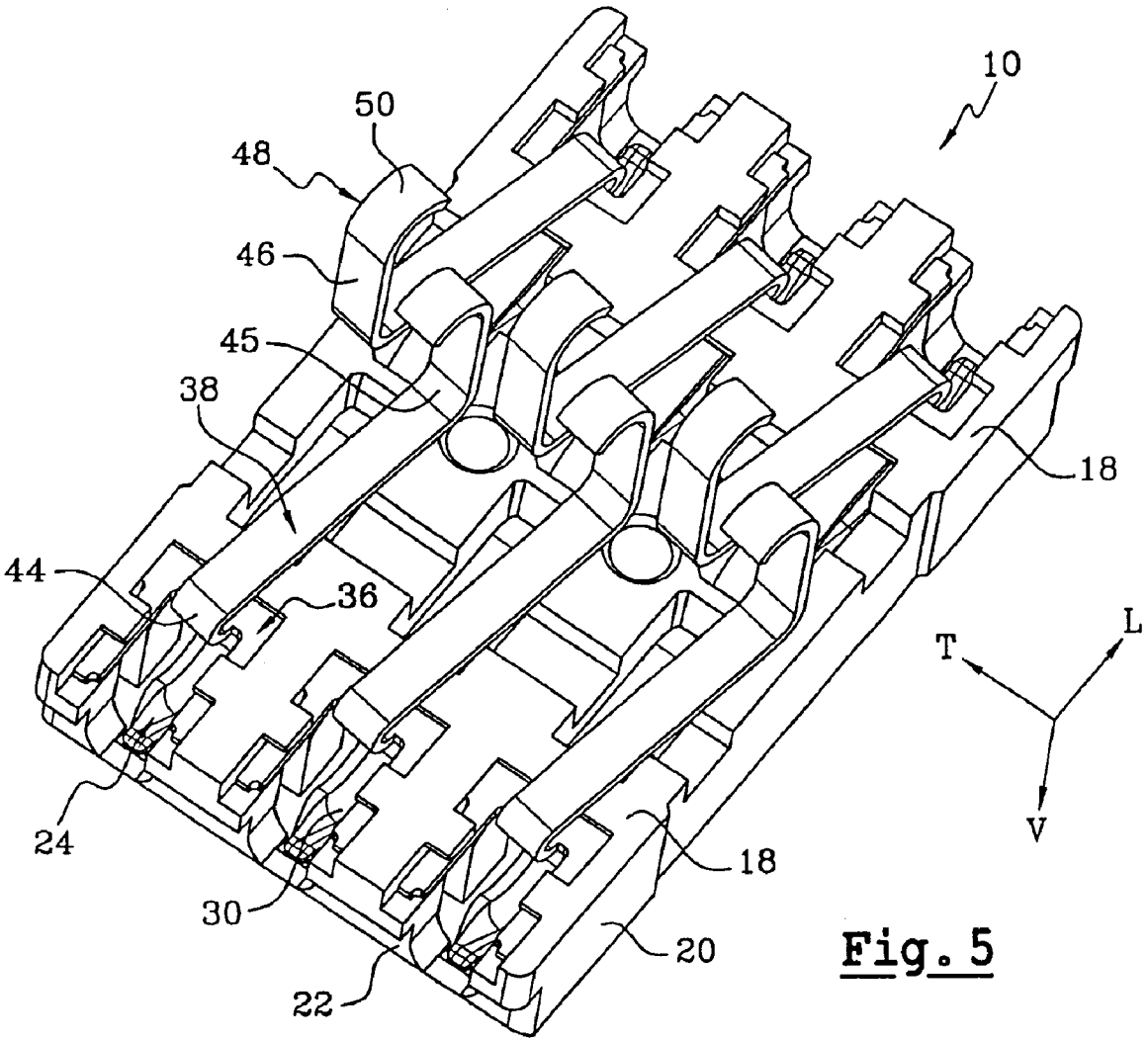
FIG. 5 is an enlarged bottom isometric view of the connector of FIG. 1.

FIG. 6 shows that each contact 14 is formed of a single metal strip having a strip centerline 72. The contact has an upper portion 32 with upper and lower branches 31, 34 and an approximately 180° loop 33 connecting their inner ends (which are closest to the other column of contacts). The centerline of the contact upper portion lies in a first vertical plane PL. The upper branch 31 has an upwardly-projecting dished part 30 for actually engaging contact pads on a smart card. The middle section 34 of the contact upper portion has an outer part 36 that is actually mounted and fixed on the insulative frame of the connector. Such fixing can be accomplished by overmolding the frame around the outer part 36 or inserting the outer part into a slot in the frame that closely receives the outer part. FIG. 5 shows the contacts inserted into cavities 24 in the frame.

The lower contact portion 38 (FIG. 6) includes a deflectable strip section 42, a vertical section 46, and a termination end 48 that actually engages a trace on the circuit board. The deflectable strip section 42 is connected to the contact upper portion by an approximately 180° loop 44 that connects to the outer part 36. The loop is bent around a horizontal axis 92. The centerline of the contact lower portion 38 lies in a second plane PB.

The first and second planes PL and PB in which the centerlines of the upper and lower contact parts lie, are angled from each other by a plurality of degrees, the particular angle being about 12° in FIG. 6. In a corresponding manner, the horizontal axis 92 of at least a lower portion of the loop 44 extends perpendicular to the second plane PB and is angled about 12° from a line normal to the first plane PL.

As shown in FIG. 3, the angle a of the deflectable strip sections 42 of the contacts from the lateral L direction, results in the termination ends 48 of the contacts being spaced apart along a connector centerline A which lies substantially between the two columns of contacts. The angle a is chosen so that along the distance E between the loop 44 and the termination end 48, the termination ends 48 have "moved" longitudinally along the line A by one half the longitudinal spacing G (FIG. 1) between the contacts of a column. As a result, the termination ends 48 of the contacts all lie approximately along the connector centerline A. All six contacts are identical and their deflectable strip sections 42 are parallel. However, the contacts in column 62 have their deflectable sections extending from the loops 44 toward the centerline A but at an acute angle incline of no more than 45° toward one side 20 of the frame while those in column 64 extend at an incline toward the other side 21 of the frame.

Figure 9:
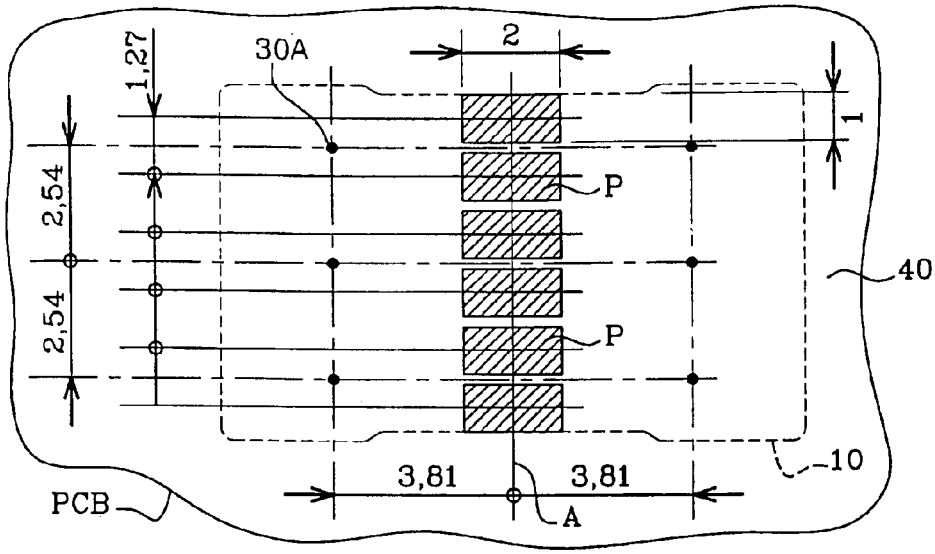
FIG. 9 is a schematic representation of a circuit board, showing the layout of contact pads for the connector of FIGS. 1–8.

FIG. 9 shows a portion of a circuit board 40, and shows conductive traces P on the circuit board, all lying along the connector centerline A. The traces P lie approximately in a simple longitudinally-extending row, in that all traces have portions lying on line A or within 1 millimeter of line A. The outline at 10 of the connector frame as seen in a plan view, is rectangular, with a considerable longitudinal width and lateral length. The lateral length, shown as 2 mm, of the row of circuit board traces P is much less than one half the lateral length of the connector frame outline. This leaves considerable space on opposite ends of the column of circuit board traces P, where components or only circuit board traces can be placed. The connector is designed for mounting on devices of small size, so the extra space available as a result of the circuit board traces lying in a narrow space, is important in leaving room for using other portions of the circuit board.

Figure 7:
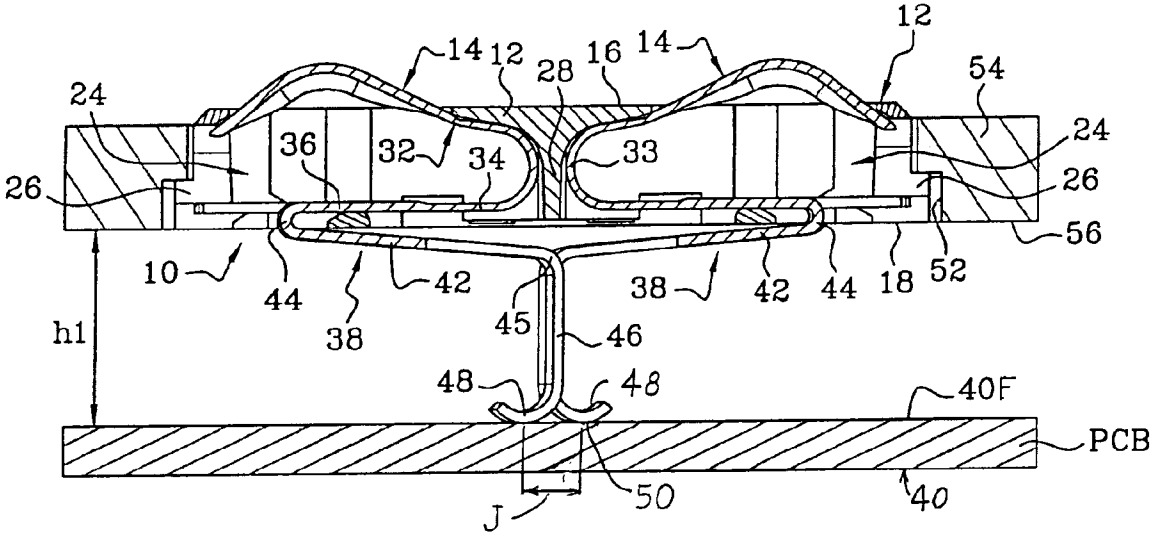
FIG. 7 is sectional view taken on line 7—7 of FIG. 1, and showing the connector lying over a circuit board but not yet pressed down against the circuit board.
Figure 8:
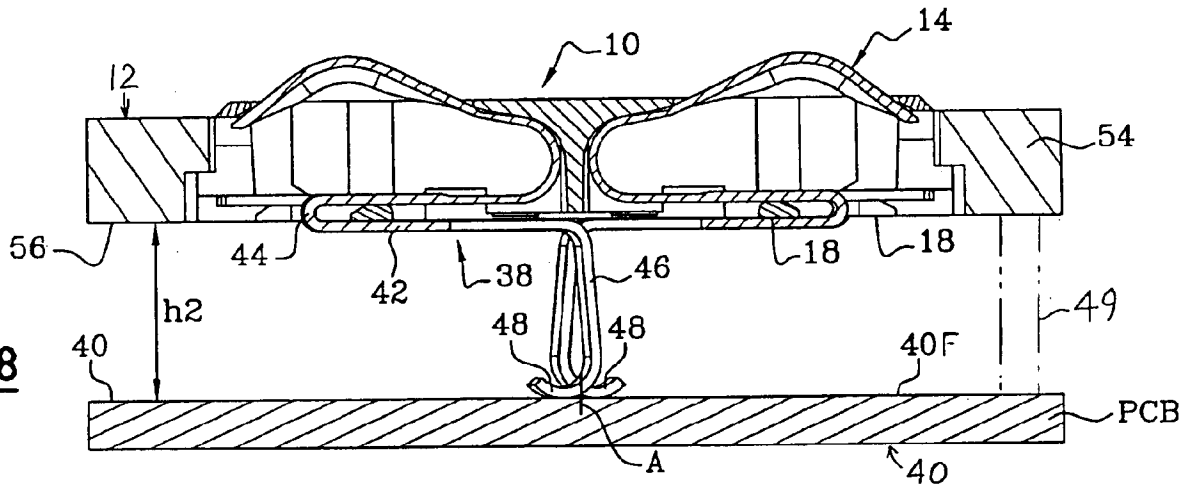
FIG. 8 is a view similar to that of FIG. 7, but showing the connector after it has been pushed down to its final position.

FIG. 7 illustrates the connector 10 prior to the connector being pressed firmly down against the circuit board 40. The termination ends 48 have lower surfaces 50 that are convexly curved, and the two contacts of a pair have the centers of their lower surfaces laterally spaced apart by a distance J. A lower face 18 of the connector frame is spaced a distance of hi from the circuit board upper face 40F. FIG. 8 illustrates the connector when the connector frame has been moved down slightly, so it is spaced a distance h2 from the circuit board upper surface 40F. A downward pressure on the connector, causes the deflectable strip sections 42 of the contacts to bend up against the lower surface 18 of the frame. In bending up, the vertical sections 46 of the contact lower portions move, until the centers of the termination ends 48 all lie approximately on the connector centerline A. The connector frame 12 is fixed to the circuit board in the position shown in FIG. 8 (e.g. by posts 49).

The considerable height h2 of the contact deflection sections 42 from the circuit board upper surface 40F provides room for circuit components of substantial thickness. The connector frame 12 has a small thickness, and in many situations the combined thickness of the space h2 and the thickness of the frame 12 can be accommodated in the device.

FIG. 7 shows that the connector frame 12 forms a partition 28 between the contacts 14 in the two columns. The partition 28 locates the loops 33 of the contacts, with other portions of the frame locating other portions of the contacts. The connector frame 12 is shown mounted in a housing 54 of the device, which has a lower face 56.

Figure 10:
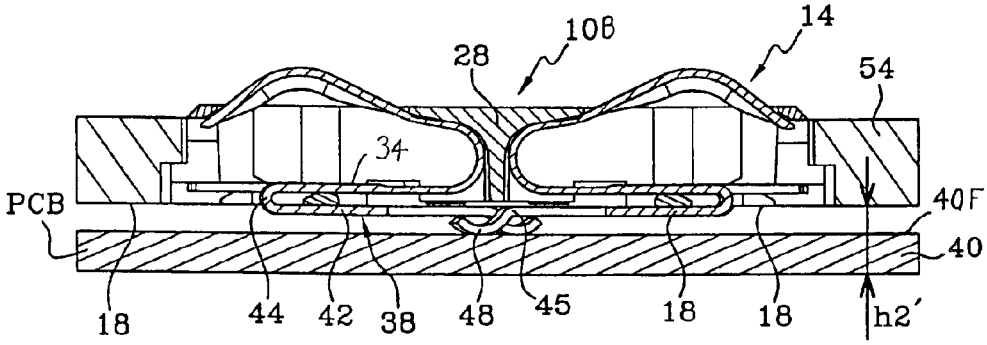
FIG. 10 is a sectional view somewhat similar to that of FIG. 8, but for a connector of another embodiment of the invention, of reduced height.
Figure 11:
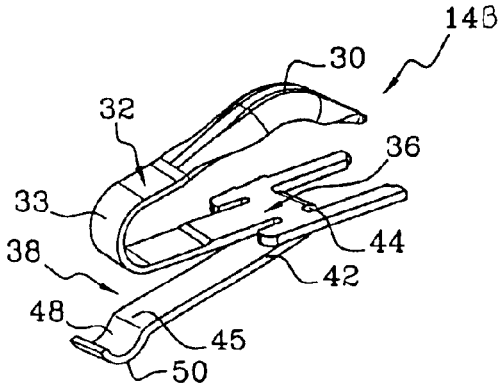
FIG. 11 is an isometric view of a contact of the connector of FIG. 10.
Figure 14:
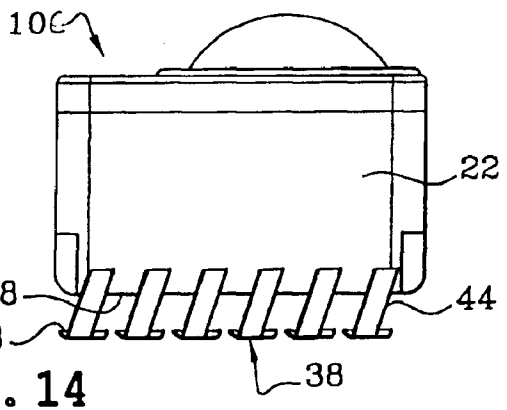
FIG. 14 is an end elevation view of the device of FIG. 13.
Figure 15:
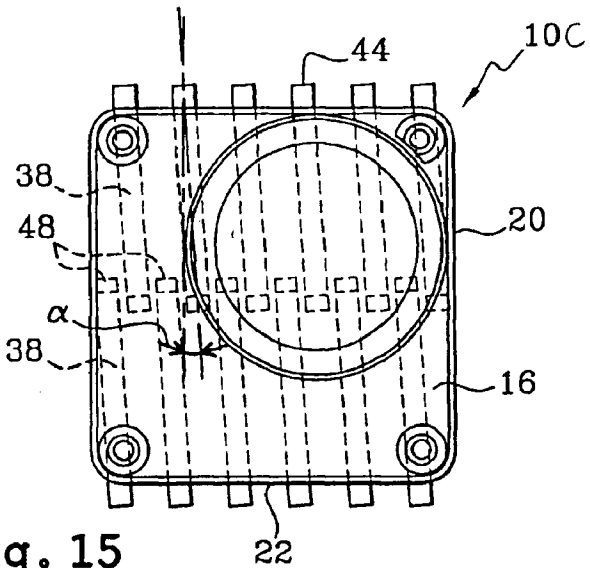
FIG. 15 is a top view of the device of FIG. 12.
Figure 13:
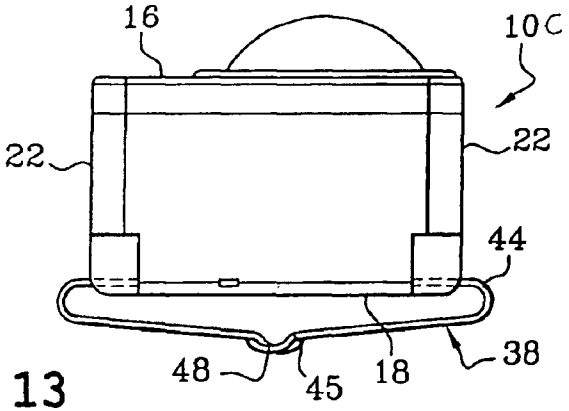
FIG. 13 is a side elevation view of the device of FIG. 12.
Figure 12:
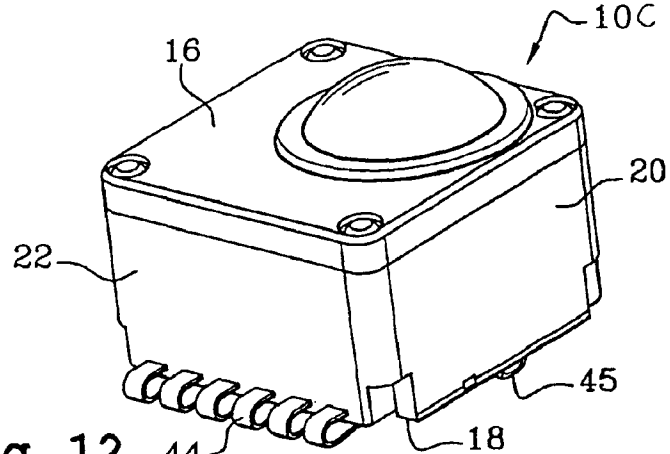
FIG. 12 is an isometric view of a track ball type device with contacts arranged in accordance with the present invention.

FIG. 10 illustrates another connector 10B which is similar to that of FIGS. 1–8, except that there is no long vertical section of the type shown at 46 in FIG. 6. Instead, the termination end 48 of each contact lies closely under the frame. Although the space between the deflectable strip sections 42 and the circuit board upper face 40F is small so that thick circuit components cannot be placed in that space, the space does allow circuit board traces to be placed on the upper face of the circuit board except near the contact traces where termination ends 48 of the contacts engage a column of circuit board traces. Applicant notes that FIG. 10 shows a slight bend at 45 connecting the deflectable strip section 42 to the termination end 48 of each contact, which spaces the deflectable strip sections from the circuit board. FIG. 11 shows one of the contacts 14B that extends only a moderate distance above the circuit board.

FIGS. 12–15 illustrate a connector 10C of the type illustrated in FIGS. 10–11, as part of a track ball device with a ball at the top that can be rotated about any axis and with LED's (not shown).

In the connector shown in phantom lines in FIG. 9 that applicants have designed, the length and width were about 12 mm and 8 mm, respectively. The pad-engaging upper ends of the contacts lay at the locations 30A, and the lateral centerlines of the contact upper portions were longitudinally spaced apart by a pitch of 2.54 mm. Each of the contact pads P were spaced apart along the line A by half that, or at a pitch of 1.27 mm. The lateral distance between the contact locations 30A of the two columns from the centerline A was 3.81 mm. Each circuit board trace P had a lateral dimension of 2 mm and a longitudinal dimension of 1 mm. The difference between heights h1 and h2 was about 0.5 mm.

While terms such as "vertical" have been used to describe the connector as it is illustrated, it should be understood that the connector can be used in any orientation with respect to the Earth.

Thus, the invention provides a miniature connector with at least two columns of contacts, for mounting on a circuit board, where the connector has contacts with termination ends that engage traces on the circuit board, and an imaginary rectangle that surrounds all traces, occupies a minimal of space on the circuit board. This is accomplished by providing a lower deflectable strip section in each contact that is angled from the upper portion of the contact, and that is angled from a lateral direction. Two columns of contacts are arranged with pairs of contacts of the two columns being spaced apart along lateral directions. The contacts of one column have their deflectable strip sections angled towards the centerline and towards one side of the connector. The contacts of the other column of contacts have the centerlines of their deflectable strip sections angled towards the connector centerline and towards the second side of the connector. The deflectable strip sections can lie high above the circuit board, and the contacts can be provided with vertical sections that extend down to termination ends of the contacts. In another arrangement, the deflectable strip sections lie closely over the circuit board.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A connector for mounting on a circuit board, the connector including an insulative frame and two laterally-spaced columns of contacts mounted on said insulative frame, the contacts in each column being spaced apart along a longitudinal direction by a predetermined spacing, each contact comprising a metal strip that has a centerline, each metal strip forming an upper contact portion with the centerline thereof lying in a vertical plane and each contact forming a lower contact portion lying below said upper contact portion, said lower contact portion having a termination end for engaging a conductive trace on the circuit board, said contacts being arranged in pairs with one contact of each pair lying in one of said columns and with the other contact of each pair lying in a different one of said columns, upper contact portions of each pair of contacts being laterally spaced apart in a lateral direction, said lateral direction being perpendicular to said longitudinal direction, and the upper contact portions of the contacts of each pair of contacts lying in the same vertical plane, wherein:

the lower contact portion of each of said contacts has a deflectable strip section with a centerline that lies in a first vertical plane and the upper contact portion of the same contact lies in a second vertical plane that is angled a plurality of degrees from the first vertical plane of the same contact, to position the termination end of the same contact so it is longitudinally spaced from the first vertical plane of the same contact by half of said predetermined spacing, and the termination ends of said contacts in said two columns all lie approximately in a single longitudinally-extending row.

2. The connector described in claim 1 including said circuit board, and wherein:

said circuit board has an upper face with a single column of termination-engaging traces, the spacing of said termination-engaging traces along said single column being half said predetermined spacing of said contacts along each of said columns of contacts.

3. The connector described in claim 1 wherein:

each of said upper contact portions has a laterally extending upper branch with an upwardly projecting contracting location, a laterally extending middle branch lying directly under said upper branch, and a first bend of about 180° joining said upper and middle branches;

each of said contacts includes a second bend that connects the lower contact portion to an end of said middle branch that is opposite said first bend, each second bend forming a bend of about 180° about an axis that is angled a plurality of degrees but no more than 45° from said longitudinal direction.

4. The connector described in claim 1 wherein:

said contacts of said two columns of contacts are all the same, but the contacts of one of said columns is oriented by being turned 180° about a vertical axis from the orientations of the contacts of the other column of contacts.

5. The connector described in claim 1 wherein:

said contacts are horizontally spaced along each of said columns;

said contact lower portions each have a vertically-extending termination section connecting an end of the deflectable strip section to the termination end.

6. A combination of a circuit board having conductive traces and a connector mounted on said circuit board wherein said connector includes an insulative frame having opposite sides and includes first and second laterally spaced columns of contacts mounted on the frame, the contacts in each column being spaced apart in a longitudinal direction, and the connector having a connector centerline that lies between said columns, the contacts of a first of said columns being laterally spaced from the contacts of a second of said columns, each contact being formed of a metal strip having opposite edges and having a strip centerline generally lying halfway between said edges, each contact having an upper portion with an elongated upper strip section for engaging to another device and having a lower portion with an elongated deflectable strip section and with a termination end for engaging one of said circuit board traces, wherein:

the elongated upper strip sections of the upper portions of said contacts all extend in said lateral direction, but the lower portion elongated deflectable strip sections each extends at an acute angle of a plurality of degrees from said lateral direction, the elongated deflectable strip sections of contacts in said first column each extending at an acute angles from the lateral direction towards said connector centerline and towards a first one of said frame sides and the elongated deflectable strip sections of contacts in said second column each extending at an acute angle from the lateral direction towards said centerline and towards the second of said frame sides.

7. The combination described in claim 6 wherein: said conductive traces on said circuit board extend along a longitudinally-extending line that lies under said connector centerline, with the pitch of said traces being half the pitch between contacts that all lie in one of said columns.

8. The combination described in claim 6 wherein:

in an initial position of said connector, said insulative frame is vertically spaced a first distance (h1) from said circuit board and said elongated deflectable strip sections (42) extend at downward inclines toward said connector centerline but their termination ends do not extend fully to a position under said connector centerline, and in a fully installed position said frame is spaced a smaller distance (h2) from said circuit board and said elongated deflectable sections are all deflected to extend at smaller inclines than in said initial orientations and their termination ends lie closer to a position under said connector centerline.

9. The connector described in claim 6 wherein:

said contacts are horizontally spaced along each of said columns;

said contact lower portions each have a vertically-extending termination section connecting an end of an elongated deflectable strip section to a termination end.

* * * * *